US005491989A

United States Patent [19]

Sasaki

[11] Patent Number: 5,491,989

[45] Date of Patent: Feb. 20, 1996

[54] YARN GUIDE AND YARN GUIDE UNIT FOR A JACQUARD KNITTING MACHINE

[76] Inventor: Etsuzo Sasaki, 1602 Toomyoji 2-chome, Fukui-shi, Fukui-ken 910, Japan

[21] Appl. No.: 363,727

[22] Filed: Dec. 23, 1994

[30] Foreign Application Priority Data

Dec. 28, 1993 [JP] Japan ..... 5-353516

[51] Int. Cl.[6] ..... D04B 27/02

[52] U.S. Cl. ..... 66/205; 66/207

[58] Field of Search ..... 66/126 A, 205, 66/207

[56] References Cited

U.S. PATENT DOCUMENTS

| | | | |
|---|---|---|---|
| 2,737,794 | 3/1956 | Bitzer | 66/126 A |
| 2,857,751 | 10/1958 | Feustel | 66/126 A |
| 4,570,462 | 2/1986 | Roth | 66/205 X |
| 4,841,750 | 6/1989 | Zorini | 66/205 X |

FOREIGN PATENT DOCUMENTS

| | | | |
|---|---|---|---|
| 130566 | 6/1901 | Germany | 66/207 |
| 2706974 | 8/1978 | Germany | 66/207 |
| 179853 | 10/1984 | Germany | 66/207 |

*Primary Examiner*—John J. Calvert
*Attorney, Agent, or Firm*—Flynn, Thiel, Boutell & Tanis

[57] ABSTRACT

A yarn guide needle has a simple construction, is capable of being operated for swing motion and lapping motion, of accurately guiding a yarn to a desired position regardless of the type or the tension of the yarn and of being driven by a simple driving mechanism. The yarn guide needle has an upper flat portion and a lower flat portion twisted relative to each other, and the yarn guide needle is supported for turning by a pivot pin attached to the upper flat portion on a pair of support plate obliquely extending relative to the row of needles. Therefore, when the yarn guide needle is turned on the pivot pin, the lower flat portion moves in a plane oblique to the row of needles for lapping motion and a guide hole formed in the lower end of the lower flat portion is shifted transversely. Since the yarn guide needle need not be bent for lapping motion, the yarn guide needle may be formed of a firm, rigid plate. The yarn guide needle can be driven for both swing motion and lapping motion simply by axially moving a control rod always in engagement with the upper flat portion of the yarn guide needle by a simple driving mechanism.

8 Claims, 6 Drawing Sheets

Fig.1A Fig.1B Fig.1C Fig.1D
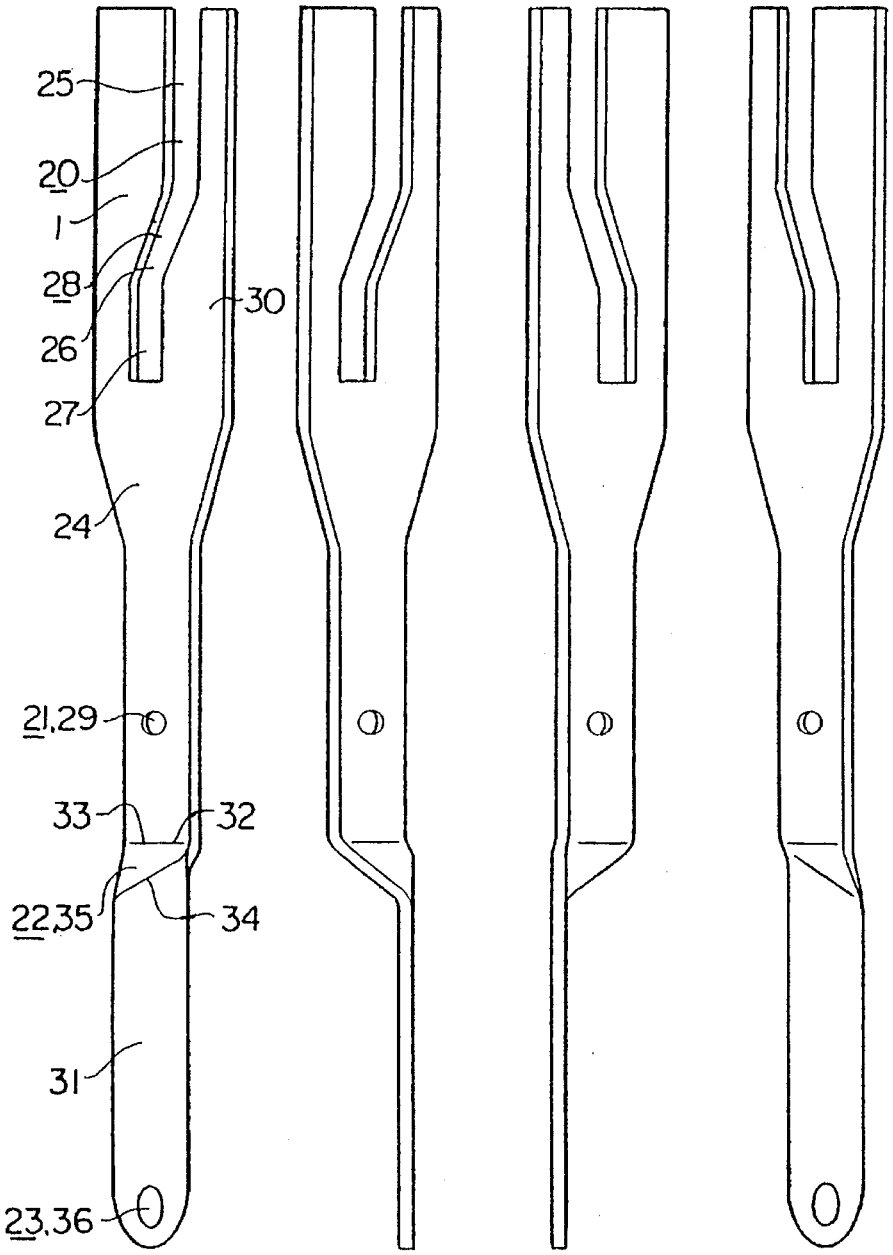
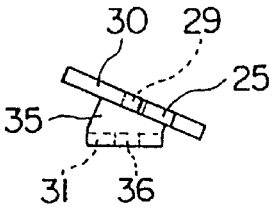
Fig.1E
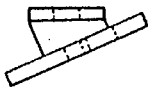
Fig.1F

YARN GUIDE AND YARN GUIDE UNIT FOR A JACQUARD KNITTING MACHINE

BACKGROUND OF THE INVENTION

1. Field of the Invention

The present invention relates to a yarn guide needle for a jacquard knitting machine, and a yarn guide unit for a jacquard knitting machine, capable of being operated by a simple mechanism and of guiding yarns of any types.

2. Description of the Related Art

Knitting machines capable of knitting figured fabrics, such as raschel knitting machines and recent tricot knitting machines, are provided with a jacquard machine for selectively guiding yarns to needles specified according to a desired pattern. FIGS. 5 and 6 show a representative yarn guide unit for a jacquard machine. This yarn guide unit is formed by uniting a yarn guide block a and a plurality of yarn guide needles b and b' provided at their tips with guide holes d and d', respectively, i.e., jacquard reeds. A dropper pin c is brought into contact with a specified one of the yarn guide needles once every one stitching cycle of the needles to control a plurality of yarns individually. Each of the yarn guide needles b and b' is bendable when the dropper pin c is brought into contact with the same. The yarn guide needles b and b' are arranged in a plurality of rows corresponding to the rows of the needles of the knitting machine.

The yarn guide block a is mounted on a yarn guide mount of the knitting machine and is operated by a complex yarn guide operating mechanism for operation to move the yarn guide needles along a rectangular path or a U-shaped path for overlapping and underlapping (hereinafter referred to as "overlapping") operations to wrap the yarns around the needles. While the yarn guide block a is reciprocated transversely through a distance corresponding to the pitch of the needles for an overlapping operation to wrap the yarns around the needles, specified dropper pins c are lowered so as to come into contact with the shoulders e of the corresponding yarn guide needles b and b' by the operation of the jacquard head according to control commands given by the jacquard machine, so that the tips of the yarn guide needles b and b' corresponding to the specified dropper pins c are restrained from movement together with the yarn guide block a by a distance corresponding to the pitch of the needles. Thus, the yarn guide needles b and b' are controlled selectively to control the yarns individually to form a pattern in the fabric.

Since the tips provided with the guide holes d and d' of the specified yarn guide needles b and b' of the yarn guide block a are restrained from transverse movement by bringing the dropper pins c into contact with the shoulders e of the specified yarn guide needles b and b' so that the specified yarn guide needles b and b' are bent, the yarn guide needles b and b' must be formed of a material capable of being elastically bent and of restoring its original shape, such as a spring plate. Smooth, fine yarns pass the guide holes d and d' of the yarn guide needles b and b' substantially without being encountered by resistance and hence a pattern can be formed in the fabric. However, when thick yarns, fuzzy yarns, stretchable yarns or highly taut yarns pass the guide holes d and d', the yarns are encountered by a high resistance and, when the yarn guide block a is driven for instantaneous transverse movement, the yarn guide needles b and b' of an elastic material are restrained from free movement by the yarns. Consequently, the guide holes d and d' cannot be accurately moved to desired positions, a desired pattern cannot be formed and, in the worst case, the yarn guide needles b and b' collide against the corresponding needles to break the needles.

Whereas unfigured portions of the fabric can be knitted simply by instantaneously reciprocating the yarn guide block a, figured portions of the fabric are formed by bringing the dropper pins c into engagement with the specified yarn guide needles b and b' of the yarn guide block a. Therefore, a yarn guide block driving unit for transversely moving the yarn guide block a and a dropper pin driving unit for vertically moving the dropper pins c must be mounted separately on the frame of the knitting machine and hence two driving and controlling systems are necessary, which complicates the construction of the knitting machine and increases the weight of the knitting machine.

SUMMARY OF THE INVENTION

The present invention has been made in consideration of the foregoing problems in the conventional yarn guide needle and the conventional yarn guide unit that the yarn guide needle is unable to guide thick yarns properly and the knitting machine provided with the yarn guide unit needs to be provided separately with a needle guide unit driving mechanism and a dropper pin driving mechanism, and it is therefore an object of the present invention to provide a yarn guide needle and a yarn guide unit for a jacquard machine, capable of properly guiding yarns of any types and of being driven by a simple driving mechanism.

A yarn guide needle in accordance with the present invention has a lower flat portion provided with a guide hole, and an upper flat portion twisted relative to the lower flat portion. The yarn guide needle is formed of a rigid material. When the yarn guide needle is driven for swing motion, the guide hole formed in the lower flat portion moves along the row of needles without entailing the distortion of the yarn guide needle, so that the yarn guide needle is capable of properly guiding yarns of any types. An operating pin attached to a control rod is set in engagement with a joining part of the upper flat portion to interlock the yarn guide needle and the control rod, the condition of engagement of the pin with the joining part is changed to move the yarn guide needle along the row of needles by a single driving mechanism.

BRIEF DESCRIPTION OF THE DRAWINGS

The above and other objects, features and advantages of the present invention will become more apparent from the following description taken in connection with the accompanying drawings, in which:

FIGS. 1A–1F are respective front, left, right, rear, top and bottom views of a yarn guide needle in accordance with the present invention for a jacquard machine;

DETAILED DESCRIPTION OF THE PREFERRED EMBODIMENTS

Figure 2:
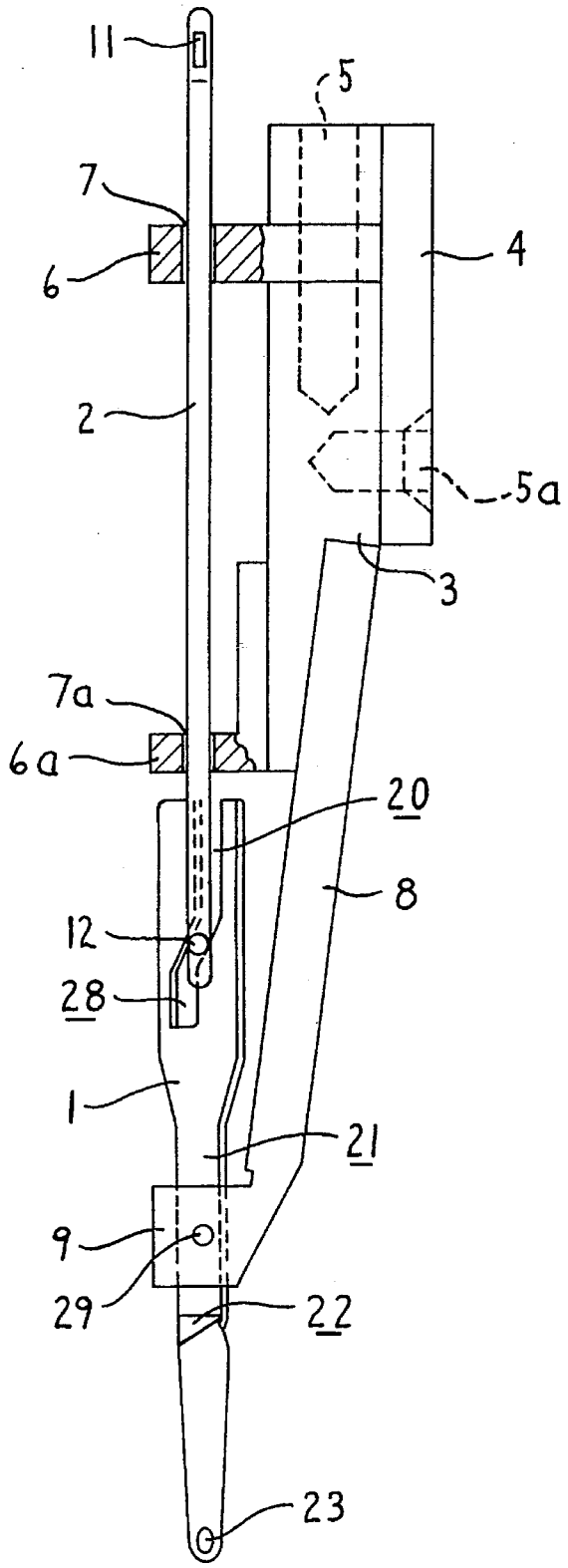
FIG. 2 is a side view of a yarn guide unit in a preferred embodiment according to the present invention for a jacquard machine.
Figure 3:
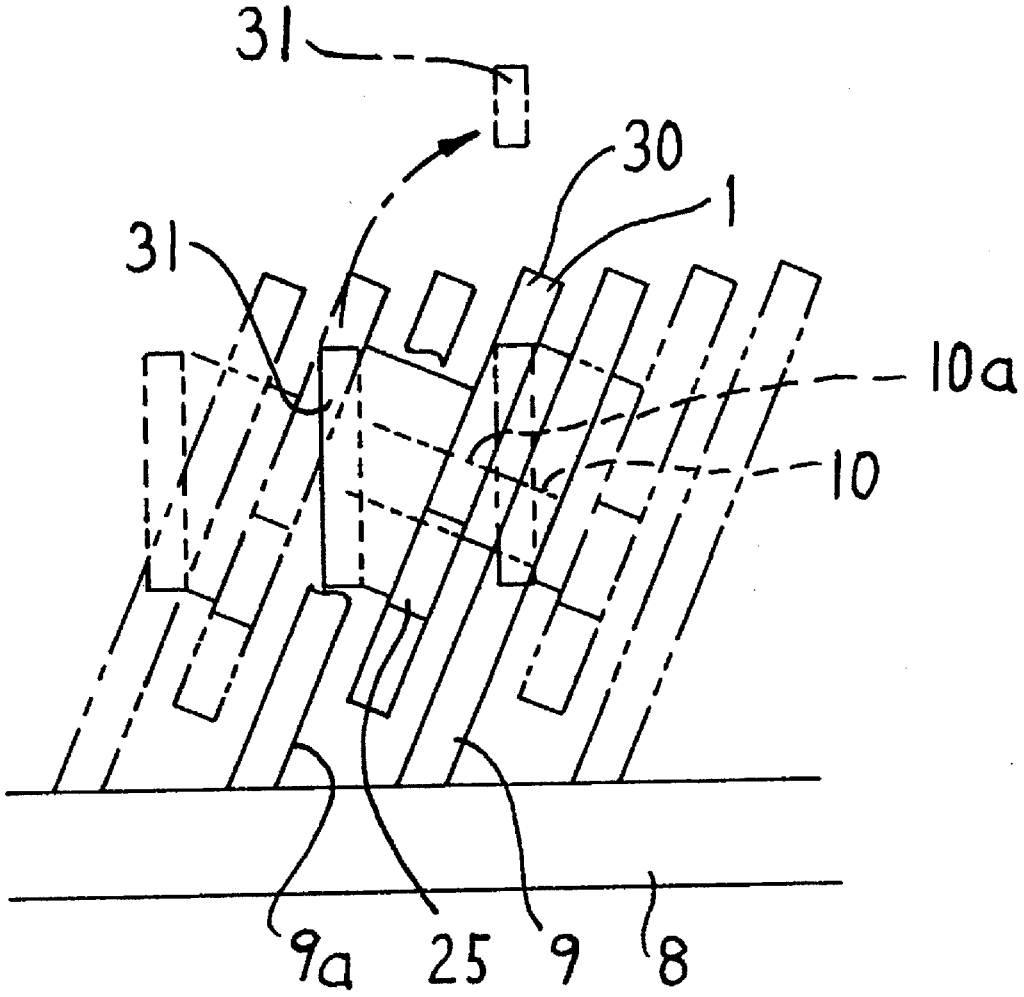
FIG. 3 is a diagrammatic view of assistance in explaining the motion of the yarn guide unit of FIG. 2.
Figure 4:
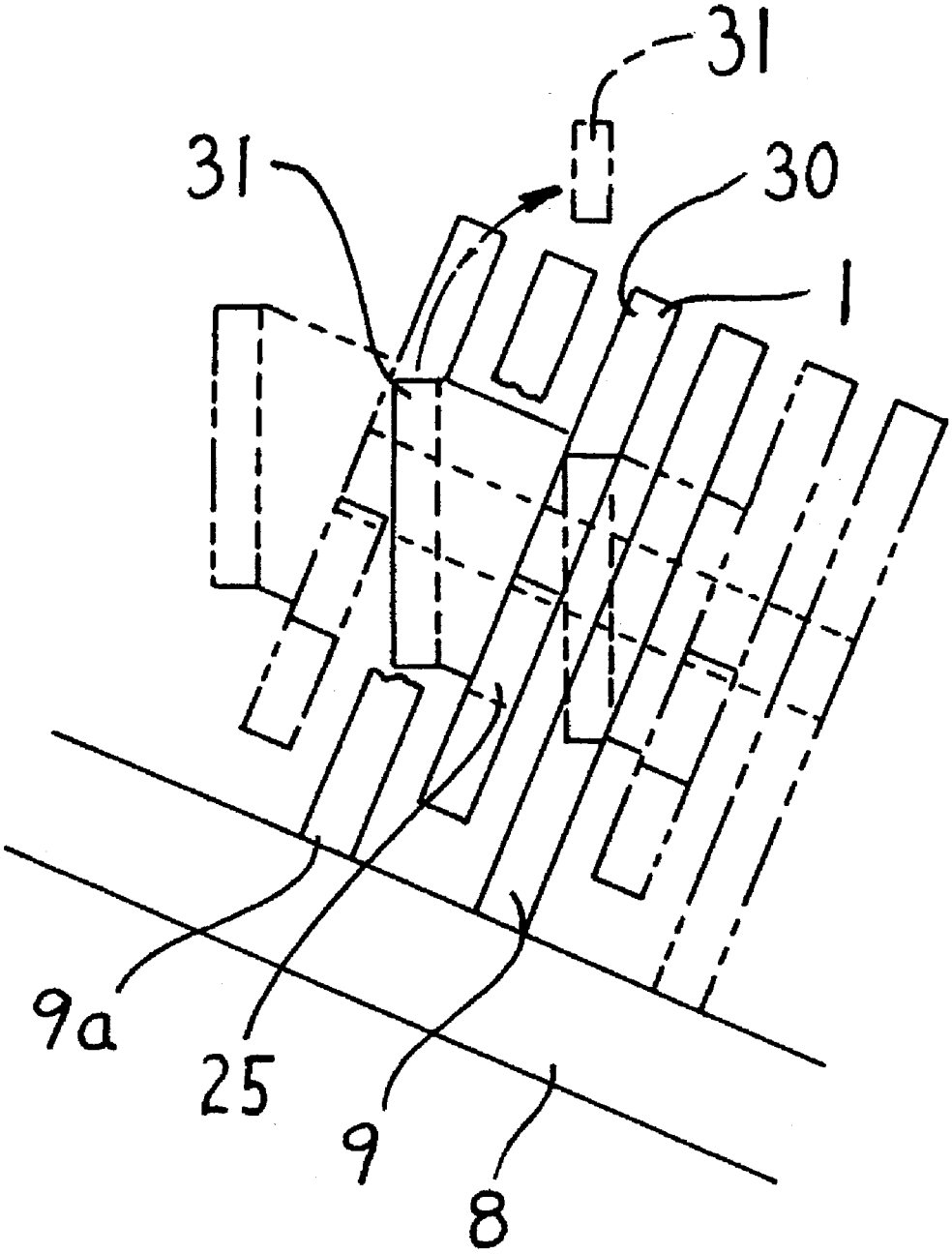
FIG. 4 is a diagrammatic view of assistance in explaining the motion of a yarn guide unit in another embodiment according to the present invention.
Figure 5:
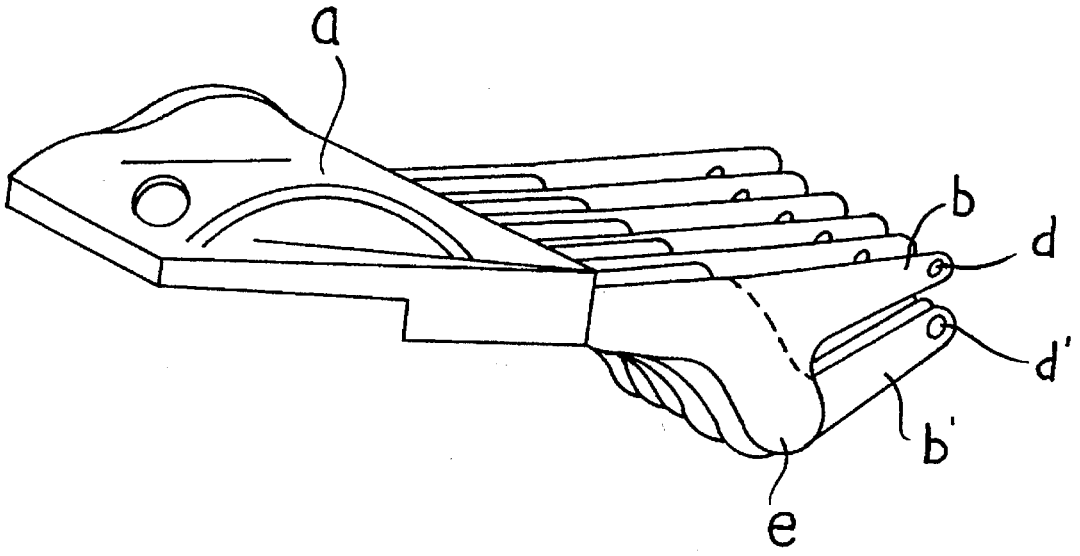
FIG. 5 PRIOR ART
FIG. 5 is a perspective view of a conventional yarn guide block.
Figure 6:
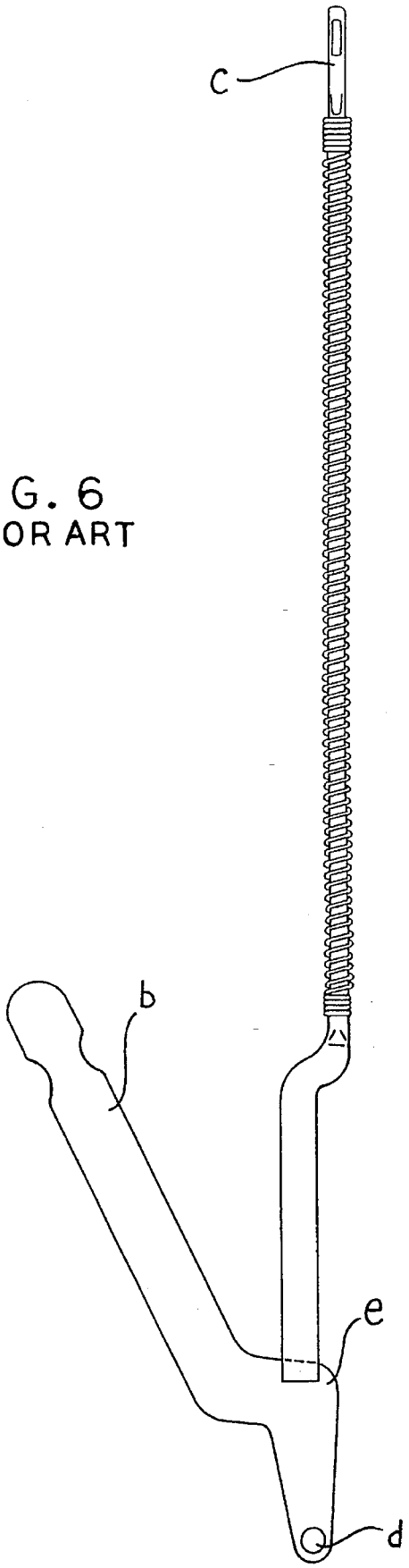
FIG. 6 PRIOR ART
FIG. 6 is a side view of a conventional yarn guide needle in engagement with a dropper pin.

Referring to FIGS. 1, 2 and 3, a yarn guide needle 1 for a jacquard machine, and a control rod 2 are supported on a block 3. The control rod is in engagement with the yarn guide needle 1 and is operated for a dropper action by the jacquard machine. A block holding bar 4 is attached to the frame, not shown, of a knitting machine by screwing bolts in threaded holes 5 and 5*a* formed therein at appropriate positions. A pair of support bars 6 and 6*a* provided respectively with guide holes 7 and 7*a* are fixed to the upper portion of the front surface of the block holding bar 4. A support frame 8 extends downward from the block holding bar 4. A given number of support plates 9 and 9*a* are attached to the front surface of the support frame 8 at equal given intervals like the teeth of a comb so as to project obliquely to the front as shown in FIG. 3. The support plates 9 and 9*a* are provided respectively with holes 10 and 10*a* having axes perpendicular or inclined to the surfaces of the support plates 9 and 9*a*.

The control rod 2 is provided with a slot 11, i.e., connecting part, in its upper end. A connecting member, not shown, of the driving unit, not shown, of a jacquard machine is engaged with the slot 11 to move the control rod 2 vertically. The control rod 2 is extended through the guide holes 7 and 7*a* of the support bars 6 and 6*a* so as to be vertically movable and an operating pin 12 is fixed to the lower end of the control rod 2.

The yarn guide needle 1 is interlocked with the control rod 2 supported on the block 3. The yarn guide needle 1 is a rigid, solid plate having an upper connecting part 20, a middle connecting part 21, a twisted part 22 and a lower guide part 23. Formed in the connecting part 20 of a flat plate 24 forming the yarn guide needle 1 is a cam groove 28 having an upper vertical section 25, an inclined section 26 and a lower vertical section 27, which are arranged continuously in that order from the upper end of the flat plate 24 downward. The middle point of the inclined section 26 is on the center axis of the flat plate 24. The operating pin 12 of the control rod 2 is fitted in the cam groove 28 having the upper vertical section 25, the inclined section 26 and the lower vertical section 27. A pivot pin 29 is attached to the middle portion of the flat plate 24. The opposite ends of the pivot pin 29 are fitted in the holes 10 and 10*a* of the support plates 9 and 9*a* to support the yarn guide needle 1 on the support frame 8.

Although the middle point of the inclined section 26 of the cam groove 28 is on the center axis of the flat plate 24, and the upper vertical section 25 and the lower vertical section 27 extend in parallel to and on the opposite sides, respectively, of the center axis of the flat plate 24 in this embodiment, the position of the middle point of the inclined section 26 need not necessarily be on the center axis of the flat plate 24, provided that the yarn guide needle 1 can be caused to swing on the pivot pin 29 when the control rod 2 having the operating pin 12 fitted in the cam groove 28 is moved vertically.

The yarn guide needle 1 has the twisted part 22 in order that the yarn guide needle 1 is supported on the support plates 9 and 9*a* with an upper flat portion 30, in which the cam groove 28 is formed, inclined to the front surface of the block 3 and a lower flat portion 31, in which the guide hole 23 is formed, perpendicular to the front surface of the block 3. The twisted part 22 is bent in one direction along the boundary line 32 between the upper flat portion 30 and the lower flat portion 31 in a bend 33, and in the other direction along an oblique line 34 extending from one end of the bend 33 to form a triangular slope 35 between the upper flat portion 30 and the lower flat portion 31. Accordingly, when the yarn guide needle 1 is supported on the support plates 9 and 9*a* inclined to the front surface of the block 3, the upper flat portion 30 is oblique to the front surface of the block 3 and the lower flat portion 31 is perpendicular to the front surface of the block 3, that is, the lower flat portion 31 is perpendicular to the row of needles. A guide hole 36 is formed in the lower end of the guide part 23 of the lower flat portion 31.

Although the edge of the bend 34 in the twisted part 22 is inclined in this embodiment, the edge of the bend 33, either the edge of the bend 33 or that of the bend 34, or both the edges of the bends 33 and 34 may be inclined, the twisted part 22 may be formed by a suitable means other than the bends 33 and 34, provided that the upper flat portion 30 and the lower flat portion 31 are twisted relative to each other.

Although the support plates 9 and 9*a* extend obliquely from the support frame 8 in this embodiment, the pivot pin 29 may be attached obliquely to the flat plate 24 forming the yarn guide needle 1, or the support plates 9 and 9*a* may be attached perpendicularly to the support frame 8 and the upper flat portion 30 and the lower flat portion 31 of the yarn guide needle 1 may be twisted accordingly relative to each other.

The operation of the yarn guide needle 1 and the yarn guide unit in accordance with the present invention will be described hereinafter.

The control rod 2 corresponding to the yarn guide needle 1 selected by the jacquard machine is lowered to move the operating pin 12 attached to the lower end of the control rod 2 along the cam groove 28. When the operating pin 12 moves down along the inclined section 26, the yarn guide needle 1 is caused to turn on the pivot pin 29 supported on the support plates 9 and 9*a*. Since the upper flat portion 30 and the lower flat portion 31 of the yarn guide needle 1 are twisted relative to each other, the upper flat portion 30 and the lower flat portion 31 turn along different paths, respectively, as the yarn guide needle 1 turns on the pivot pin 29; that is, since the upper flat portion 30 and the lower flat portion 31 are twisted relative to each other and the pivot pin 29 perpendicularly attached to the upper flat portion 30 is inclined to the row of needles, the lower flat portion 31 turns in a plane inclined relative to the row of needles and hence the guide hole 36 formed in the lower end of the lower flat portion 31 moves a distance corresponding to the pitch of the needles along the row of needles.

Although the initial position of the operating pin 12 of the control rod 2 is in the upper vertical section 25 and the control rod 2 is lowered so that the operating pin 12 moves downward successively through the upper vertical section 25, the inclined section 26 and the lower vertical section 27 to turn the yarn guide needle 1 in this embodiment, the initial position of the operating pin 12 may be in the inclined section 26 and the control rod 2 may be raised or lowered so that the operating pin 12 moves upward or downward for the same purpose.

The yarn guide needle 1 of the present invention is a single solid plate having the upper flat portion 30 and a lower flat portion 31 continuously connected by the twisted part 22 and the yarn guide needle 1 can be readily fabricated.

Since the upper flat portion 30 is twisted relative to the lower flat portion 31, the upper connecting part 20 is formed in the upper flat portion 30, the pivot pin 29 is attached perpendicularly to the upper flat portion 30, and the pivot pin 29 is supported on the support plates 9 and 9*a* inclined at an angle to the row of needles, the guide hole 36 formed in the lower end of the guide part 23 of the lower flat portion 31 can be moved a distance corresponding to the pitch of the needles along the row of needles by operating the yarn guide needle 1 at the upper connecting part 20 by the control rod 2. Since the yarn guide needle 1 need not be bent to move the guide hole 36 a distance corresponding to the pitch of the needles along the row of needles, the yarn guide needle 1 may be firm and rigid. Accordingly, the yarn guide needle 1 is hardly distorted even if a large force is applied by the yarn and hence is capable of guiding the yarn correctly to a desired position and of preventing breaking the needle by collision between the yarn guide needle 1 and the needle.

Since the twisted part 22 has the bend 33 forming an edge perpendicular to the axis of the yarn guide needle 1, and the bend 34 forming an edge inclined to the axis of the yarn guide needle 1, the lower flat portion 31 can be easily twisted relative to the upper flat portion 30, and the guide hole 36 formed in the guide part 23 can be moved along the row of needles by the agency of the twisted part 22. Thus, the yarn guide needle 1 can be manufactured at a reduced cost.

Since the yarn guide needle 1 is supported for swing motion by the pivot pin 29 attached to the connecting part 21 thereof on the support plates 9 and 9*a* attached to the support frame 8 held on the block 3, the control rod 2 is axially slidably supported for vertical movement on the block 3, and the operating pin 12 attached to the lower end of the control rod 2 is in engagement with the upper connecting part 20 of the upper flat portion 30 of the yarn guide needle 1, the conventional jacquard machine can be used without requiring large modification for operating the control rod 2.

In the conventional yarn guide unit, the unit of the yarn guide needles and the unit of the control rods are mounted separately on the frame of the knitting machine and are driven individually by separate driving systems. Accordingly to the present invention, both the unit of the yarn guide needles 1 and the unit of the control rods 2 are mounted on the single block 3, the control rods 2 are always interlocked with the corresponding yarn guide needles 1, and the yarn guide needles 1 can be operated by operating the control rods 2 by a single driving system, which simplifies the construction of the knitting machine.

Since the upper flat portion 30 of the yarn guide needle 1 is provided with the cam groove 28 having the upper vertical section 25, the middle inclined section 26 and the lower vertical section 27, and the operating pin 12 attached to the lower end of the control rod 2 is fitted in the cam groove 28, the yarn guide needle 1 can be turned simply by moving the operating pin 12 in the cam groove 28. When the initial position of the operating pin 12 is in the middle inclined section 26 of the cam groove, the guide hole 36 of the yarn guide needle 1 can be moved along the row of needles in either of opposite directions by moving the operating pin 12 either upward or downward in the middle inclined section 26.

Although the invention has been described in its preferred form with a certain degree of particularity, obviously many changes and variations are possible therein. It is therefore to be understood that the present invention may be practiced otherwise than as specifically described herein without departing from the scope and spirit thereof.

What is claimed is:

1. A yarn guide needle for a jacquard knitting machine comprising: an upper flat portion, a lower flat portion, and a twisted portion interconnecting the upper flat portion and the lower flat portion so that the upper flat portion and the lower flat portion are twisted so as to be disposed transverse relative to each other, wherein the upper flat portion includes a cam groove to be engaged with an operating pin operatively attached to the lower end of a control rod to provide swing motion and lapping motion, and the lower flat portion includes a yarn-receiving guide hole at a lower end thereof through which yarn is extended.

2. The yarn guide needle according to claim 1, wherein the twisted portion has a bend in one direction along a line perpendicular to a longitudinal axis of the yarn guide needle, and an inclined bend in another direction along a line inclined at an angle relative to the longitudinal axis of the yarn guide needle.

3. The yarn guide needle according to claim 1 wherein said yarn guide needle is a single-piece formed from a flat plate.

4. A yarn guide unit for a jacquard knitting machine, comprising: a row of yarn guide needles, each said yarn guide needle having an upper flat portion which includes a cam groove, a lower flat portion which includes a guide hole for receiving yarn, and a twisted portion interconnecting the upper flat portion and the lower flat portion so that the upper flat portion and the lower flat portion are twisted so to be disposed transverse relative to each other, a block attached to the frame of the jacquard knitting machine, a support frame held on the block, support plates attached to the support frame so as to extend obliquely to the row of yarn guide needles, pivot pins attached to at least one of the support plates, each said yarn guide needle supported for swing motion and lapping motion on at least one of the adjacent support plates by the pivot pin attached thereto, and control rods axially slidably supported for vertical movement on the block and each having a lower end which includes an interlocking part in engagement with the cam groove of the upper flat portion of the yarn guide needle corresponding thereto.

5. The yarn guide needle according to claim 4, wherein the cam groove of the upper flat portion of the yarn guide needle has an upper vertical section, a middle inclined section and a lower vertical section, and the interlocking part of the control rod is an operating pin in sliding engagement with the cam groove.

6. The yarn guide needle according to claim 4, wherein the twisted portion has a first bend in a first direction along a line perpendicular to a longitudinal axis of the yarn guide needle, and a second bend in a second direction along a line inclined at an angle relative to the longitudinal axis of the yarn guide needle.

7. The yarn guide unit according to claim 4 wherein said yarn guide needle is a single-piece formed from a flat plate.

8. An elongated yarn guide needle for a jacquard knitting machine having a one-piece construction formed from a single flat plate, comprising: a longitudinally elongated upper flat portion, a longitudinally elongated lower flat portion disposed generally in longitudinal axial alignment with the upper flat portion, and a twisted portion interconnecting the upper flat and lower flat portions so that the upper flat and lower flat portions are twisted about the longitudinal axis so as to be disposed transverse relative to each other, said upper flat portion including an elongated cam groove to be engaged with an operating pin operatively attached to the lower end of a control rod to provide swing motion and lapping motion, and the lower flat portion including a yarn-receiving guide hole at a lower end thereof through which yarn is extended.

* * * * *